United States Patent [19]

Dörrie et al.

[11] 4,375,642

[45] Mar. 1, 1983

[54] ROD ANTENNA, PARTICULARLY FOR MOBILE FM SIGNAL TRANSDUCING APPLICATIONS

[75] Inventors: Horst Dörrie; Kurt Klinkwitz, both of Berlin, Fed. Rep. of Germany

[73] Assignee: Robert Bosch GmbH, Stuttgart, Fed. Rep. of Germany

[21] Appl. No.: 284,696

[22] Filed: Jul. 20, 1981

[30] Foreign Application Priority Data

Sep. 25, 1980 [DE] Fed. Rep. of Germany ..... 3036084

[51] Int. Cl.[3] ..... H01Q 1/36

[52] U.S. Cl. ..... 343/895; 343/749

[58] Field of Search ..... 343/895, 750, 749, 715, 343/702, 787, 788

[56] References Cited

U.S. PATENT DOCUMENTS

| | | | |
|---|---|---|---|
| 3,249,945 | 5/1966 | Lewis | 343/749 |
| 4,101,898 | 7/1978 | Ingram | 343/715 |
| 4,270,128 | 5/1981 | Drewett | 343/895 |

*Primary Examiner*—David K. Moore

*Attorney, Agent, or Firm*—Frishauf, Holtz, Goodman & Woodward

[57] ABSTRACT

To provide a short FM antenna, of about for example 40 cm length for mobile radio, for example automobile radio application, without degradation of signal strength with respect to an about 1 m long FM antenna, a conically tapering insulating rod, for example of fiberglass, has two windings applied thereover, the two windings, each, having a straight wire length of about ¼ the median wavelength of the FM band, and the overall length (l) of the rod having said two windings applied thereover being about ⅛ of the median wavelength. The oppositely wound windings (11, 12) are connected at their center, and may be formed as one bifilar winding, with the lower end of the lower winding being connected to an electrical terminal for standard connection to, for example, a coaxial antenna connector for an automobile radio. A spiral spring can be interposed if extreme deflectability of the antenna is desired, for example to prevent damage if the antenna, applied to an automotive vehicle, is passed through a power washing and scrubbing station.

11 Claims, 3 Drawing Figures

ROD ANTENNA, PARTICULARLY FOR MOBILE FM SIGNAL TRANSDUCING APPLICATIONS

The present invention relates to a rod antenna, and more particularly to a rod antenna for mobile applications, for example for use with an automobile radio or the like, and especially adapted for receiving FM signals although, of course, the antenna can be used equally for radiation of signals in a band for which it is designed.

BACKGROUND

Rod antennae which are made of insulating material, for example fiberglass or the like, with a wire wound thereon, are known—see U.S. Pat. No. 2,938,210. The wire is wound over essentially the entire length of the rod. The end of the winding at the upper end of the rod, that is, remote from its socket which is adapted to be secured to a vehicle, for example, is carried through a hole within the rod and electrically connected to a sleeve connector, such as a coaxial connector, fitting against the lower end of the rod. The rod as well as the winding are covered by an insulating material, for example of plastic or the like.

Rod antennae of this type intended for use in the frequency modulation (FM) band should have a length of about 1 meter. For mobile use, as an automobile radio antenna, for example, it is desired to have as short as possible an antenna, for example a length of only about 40 cm. Reducing the antenna length to that extent causes a loss in signal, however, which in the FM band may be between about 14 to 20 dB with respect to a simple rod antenna of about 95 cm length, that is, approaching 1 m.

THE INVENTION

It is an object to provide an antenna which can have, physically, a short length but which, nevertheless has good signal gain and signal reception characteristics.

Briefly, an insulating rod is provided which is wound with a first winding, wound, spirally progressing, in a first direction, along a longitudinal portion of the rod; a second winding, and wound, spirally progressing, on an adjacent second portion of the rod, is applied over the rod, the direction of winding of the second winding being opposite to that of the first winding. The two windings are connected at adjacent ends, that is, along an intermediate point of the rod. The sum of the length of the the rod covered by wires forming the winding i.e. the first and the second portions should be about $\frac{1}{8}$ of the median wave length of the signal band of operation of the antenna.

The antenna has the advantage that, in comparison to the frequency spectra and the directional diagram of a simple rod antenna of standard length, the transduced signal will be approximately of the same signal strength. It is possible, usually, to eliminate a preamplifier which previously was used with a foreshortened antenna, so that the additional distortion or noise introduced by the preamplifier can be eliminated.

In accordance with a feature of the invention, the extended length of the first and second winding, each, should be approximately $\frac{1}{4}$ of the median wave length of the frequency band. The antenna, then, will provide for optimal reception.

DRAWINGS

The rod antenna is made of an insulating longitudinal rod 10 which tapers upwardly. A typical material is fiberglass. The length l of the rod which corresponds to almost the entire length thereof is subdivided into two portions a and b, on which respective windings 12 and 11 are wound, spirally progressing, in opposite directions of winding. The windings 11, 12 are formed by bifilar winding of a single wire, and adhered to the fiberglass rod by an adhesive applied thereover, a lacquer, paint or the like. The length of the wires 11, 12 wound over the respective portions a and b, each, are about the same, so that the covered portions a and b will be different due to the reduction in cross section of the rod as it approaches its upper end.

The length l of the rod antenna corresponds approximately to $\frac{1}{8}$ of the median wave length. For the entertainment FM band, this means about 40 cm. The wire of the windings 11, 12 each has a straight line extent of about $\frac{1}{4}$ of the median wave length.

Figure 1:
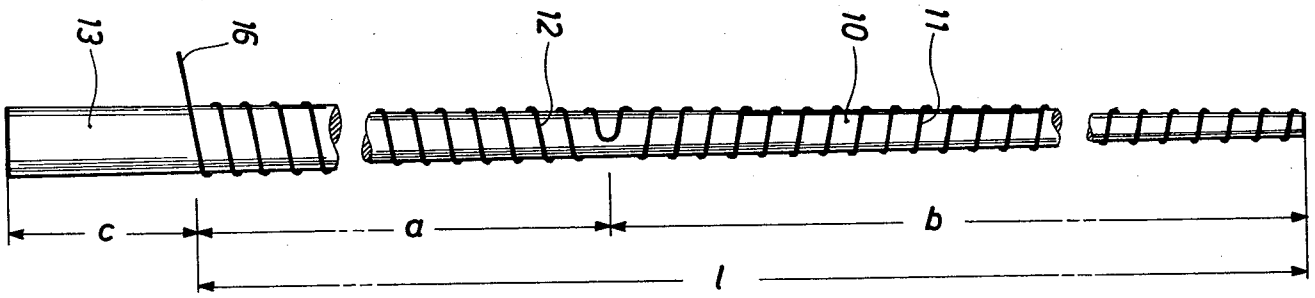
FIG. 1 is a side view of the rod antenna wound on a conical insulating rod with a bifilar winding.
Figure 2:
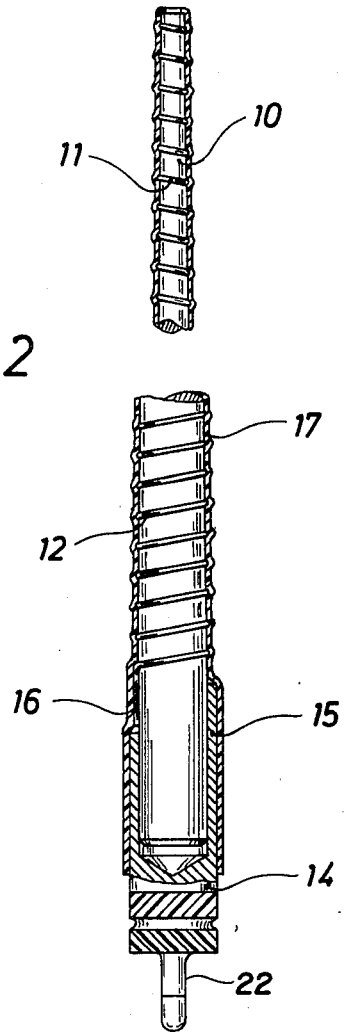
FIG. 2 is a longitudinal sectional view of an antenna surrounded by a shrunk-on tube, and illustrating a connecting terminal.

The lower winding portion 12 terminates from the lower end 13 of the rod by a distance c. The lower end 13 is not covered with winding and is provided to permit attachment of an insulating fitting 14 (FIG. 2) thereto with an inner, conductive sleeve-like extension 15. The free end 16 of the lower winding 12 is electrically connected with the conductive sleeve 15. The sleeve 15 is connected in well known manner to a connecting pin 22. The upper end of the other winding 11 is left unconnected and merely mechanically adhered to the insulating rod 10. The windings 11, 12 and the remaining portion of the insulating rod 10, as well as the attachment sleeve 15 of the connecting element 14, are commonly surrounded by an elastic protective coating 17. A suitable element is a heat-shrinkable plastic tube, which can be slipped over the rod and the sleeve 15 and then exposed to a suitable temperature, whereupon it will shrink to provide a tight fit. Heat shrink tubing is commercially available.

The connecting element 14 is used to secure the rod antenna to a connecting fitting—not shown—and standard in the industry, for example attached to the body of an automotive vehicle, for further connection to a cable and then to an automobile radio receiver.

Figure 3:
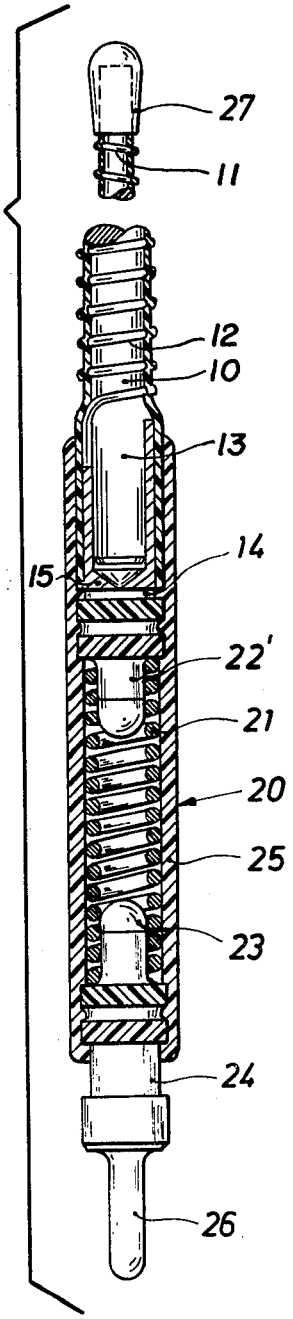
FIG. 3 is a part-sectional view of the antenna in which the lower end of the insulating rod is connected to an electrical terminal by an elastic intermediate element.

In some installations, it is desired to provide for the ability of the rod to deflect substantially from an essentially vertical position, for example in order to permit the rod to bend when attached to a vehicle which is run through an automatic automobile washing and scrubbing station. Antennae which can deflect substantially are less subject to damage. The embodiment of FIG. 3 illustrates a connecting element which has a highly resilient intermediate portion 20. The resilient intermediate portion 20 includes a spiral spring 21, one end of which is connected to the pin-like end 22' at the free end of the terminal portion 14, and the other end of which is held in a pin-like upwardly extending projection 23 of a further connecting element 24. The spring 21 thus forms a resilient mechanical connection for the rod and additionally functions as a ground loading coil. Coils connected to an end of a whip or rod antenna are well known. The function of such a coil element as a ground loading coil is inherent in the structure. The connecting element 14, spring 21, and the further connecting element 24 are surrounded by a highly elastic cover sleeve, for example by a polyvinylchloride (PVC) sleeve, applied thereover, for example, by a friction or press or shrink fit.

The connecting element 24 has a connection pin 26 which is free from the elastic sleeve 25 and which forms the electrical connection to the antenna. A protective cap 27 is applied to the tip end of the antenna.

Various changes and modifications may be made within the scope of the inventive concept.

We claim:

1. Rod antenna for transducing radio signals, particularly for mobile frequency modulation (FM) reception having a support rod (10) of insulating material, and comprising a first, spiral winding (11) wound and spirally progressing on a first longitudinal portion (b) of the rod;

a second winding (12) wound and spirally progressing on an adjacent second portion (a) of the rod, the winding sense and spiral progression of said second winding being opposite to that of said first winding, and said windings being connected at the adjacent ends at an intermediate location along the length of the rod;

an electrical connection element (14, 22; 20, 26) electrically connected to the free end (16) of one (12) of said windings;

wherein the sum of the lengths of the rod of the first and second portions over which said windings extend (a+b) is about $\frac{1}{8}$ of the median wave length of the radio signals to be transduced;

and wherein the extended wire length of the respective first and second windings (11, 12), each, is about $\frac{1}{4}$ of the median wave length of the signals to be transduced.

2. Antenna according to claim 1, further including a protective cover (17, 25) comprising heat shrinkable plastic tubing.

3. Antenna according to claim 1, wherein the first and second windings comprise a single bifilar wound wire.

4. Antenna according to claim 1, wherein said first and second windings (11, 12) are adhesively secured to the rod (10).

5. Antenna according to claim 1, further including an elastic cover layer (17) surrounding said first and second windings and said rod.

6. Antenna according to claim 5, wherein the rod (10) has an end portion (13) free from windings;

and wherein the electrical connection element (14, 22, 20, 26) includes an attachment sleeve (15) secured to the free end portion (13) of the rod, the free end (16) of the adjacent winding (12) being electrically connected to said sleeve (15).

7. Antenna according to claim 6, further including an elastic cover layer (17) surrounding said first and second windings and said rod;

and wherein the elastic cover (17) additionally surrounds said sleeve (15).

8. Antenna according to claim 1, wherein the connection element includes a highly resilient deflecting intermediate connecting element (20) secured to the lower portion (13) of the rod;

and attachment means (24) secured to said highly elastic portion.

9. Antenna according to claim 8, wherein the highly elastic portion comprises a helical spring (21) being mechanically secured to said attachment means and to said rod (10), and electrically connected to said free end (16) of the one (12) of the windings at one end, and to a connecting pin (26) at the other to form, simultaneously, a resilient mechanical connection and a ground loading coil.

10. Antenna according to claim 9, further including a highly elastic cover sleeve (25) surrounding said helical spring.

11. Antenna according to claim 1, wherein said rod comprises a fiberglass rod which tapers upwardly.

* * * * *